US012760981B2

(12) United States Patent
Richey

(10) Patent No.: US 12,760,981 B2
(45) **Date of Patent: *Oct. 13, 2026**

(54) SYSTEM FOR COOLING AUTOMATIC FIREARMS AND CANNONS

(71) Applicant: Allen Wayne Richey, Cleveland, SC (US)

(72) Inventor: Allen Wayne Richey, Cleveland, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/368,047

(22) Filed: Oct. 24, 2025

(65) Prior Publication Data

US 2026/0118083 A1 Apr. 30, 2026

Related U.S. Application Data

(63) Continuation-in-part of application No. 19/344,902, filed on Sep. 30, 2025, now Pat. No. 12,618,629, which is a continuation-in-part of application No. 18/926,684, filed on Oct. 25, 2024, now Pat. No. 12,455,133.

(51) Int. Cl.
*F41A 21/24* (2006.01)

(52) U.S. Cl.
CPC ..... *F41A 21/24* (2013.01)

(58) Field of Classification Search
CPC ..... F41A 13/12; F41A 21/02; F41A 21/10; F41A 21/20; F41A 21/24
See application file for complete search history.

(56) References Cited

U.S. PATENT DOCUMENTS

| | | | | |
|---|---|---|---|---|
| 1,452,123 | A | 4/1923 | McCrudden | |
| 1,527,585 | A * | 2/1925 | Hamilton | F41A 13/10 89/14.1 |
| 2,112,144 | A | 3/1938 | Coupland | |
| 2,287,066 | A | 6/1942 | Rogers | |
| 2,850,828 | A | 9/1958 | Sullivan | |
| 2,935,912 | A | 5/1960 | Hartley | |
| 2,981,155 | A | 4/1961 | Conrad | |
| 3,118,243 | A | 1/1964 | Manshel | |
| 4,841,836 | A | 6/1989 | Bundy | |
| 4,982,648 | A | 1/1991 | Bol et al. | |
| 5,837,921 | A | 11/1998 | Rinaldi et al. | |
| 6,311,602 | B1 | 11/2001 | Gerber et al. | |
| 7,418,848 | B2 | 9/2008 | Im | |
| 7,464,496 | B1 | 12/2008 | Davies | |
| 11,079,194 | B1 * | 8/2021 | Sinnema | F41A 21/02 |
| 12,455,133 | B1 | 10/2025 | Richey | |
| 2002/0083823 | A1 | 7/2002 | Gerber et al. | |

(Continued)

FOREIGN PATENT DOCUMENTS

| | | | |
|---|---|---|---|
| FR | 836428 | A | 1/1931 |
| FR | 1157227 | A | 5/1958 |
| GB | 127282 | A | 6/1919 |

OTHER PUBLICATIONS

Non-Final Office Action issued Dec. 27, 2024 is U.S. Appl. No. 18/926,684; 13 pages.

(Continued)

*Primary Examiner* — Bret Hayes
(74) *Attorney, Agent, or Firm* — Thrive IP

(57) ABSTRACT

A barrel cooling system for a weapon includes a corrosion prevention cylinder between a barrel and cooling fins arranged around the cylinder.

2 Claims, 6 Drawing Sheets

(56) References Cited

U.S. PATENT DOCUMENTS

| | | | | |
|---|---|---|---|---|
| 2003/0010187 | A1 | 1/2003 | Muirhead | |
| 2014/0076135 | A1 | 3/2014 | Balthaser | |
| 2014/0082990 | A1 | 3/2014 | Lee | |
| 2016/0209144 | A1 | 7/2016 | Tertin et al. | |
| 2016/0273861 | A1 | 9/2016 | Lagenbeck | |
| 2017/0045322 | A1 | 2/2017 | Fiedorowicz | |
| 2017/0261280 | A1 | 9/2017 | Glisovic | |
| 2018/0023913 | A1 | 1/2018 | Newman | |
| 2018/0120044 | A1 | 5/2018 | Lagenbeck | |
| 2020/0300566 | A1* | 9/2020 | Baker | F41A 21/24 |
| 2020/0408477 | A1 | 12/2020 | Glisovic | |
| 2022/0049919 | A1 | 2/2022 | Lagenbeck | |
| 2023/0213299 | A1* | 7/2023 | McHann | F41A 21/02 42/76.01 |
| 2024/0271896 | A1 | 8/2024 | Eck | |
| 2026/0118082 | A1 | 4/2026 | Richey | |

OTHER PUBLICATIONS

Final Office Action issued Aug. 21, 2025 is U.S. Appl. No. 18/926,684; 17 pages.

Notice of Allowance issued Oct. 25, 2024 in U.S. Appl. No. 18/926,684; 7 pages.

Brass VS Copper: Their Difference. Lie, Jack. <https://web.archive.org/web/20230604212212/https://www.runsom.com/blog/brass-vs-copper-their-difference/>. Jun. 4, 2023. (Year: 2023); 18 pages.

An identification of an earlier application pursuant to 37 CFR 1.98 (d) (1) is attached listing: Parent U.S. Appl. No. 12/455,133, filed Oct. 28, 2025; 1 page.

Non-Final Office Action issued Nov. 18, 2025 in U.S. Appl. No. 19/344,902; 9 pages.

* cited by examiner

SYSTEM FOR COOLING AUTOMATIC FIREARMS AND CANNONS

CROSS REFERENCE TO RELATED APPLICATIONS

This utility patent application is a Continuation-in-Part application of U.S. Utility patent application Ser. No. 19/344,902 filed in the United States Patent and Trademark Office ("USPTO") on Sep. 30, 2025, which is a Continuation-in-Part application of U.S. Utility patent application Ser. No. 18/926,684 filed in the USPTO on Oct. 25, 2024, both of which are incorporated by reference thereto in their entireties.

BACKGROUND OF THE DISCLOSURE

Rapid-fire weapons and firearms, such as machine guns, ground artillery, tanks, and airborne cannons, are well known. Due to their high firing rates, the barrels of such weapons become extremely hot, and if the heat is not quickly dissipated, the weapons can be damaged and rendered unusable. For decades, various attempts have been made to keep barrels cool, as well as adjacent receivers, chambers, and other parts of rapid-fire weapons and firearms, to protect them from excess heat. Some approaches use water-cooling, others use vents, and still others suggest changing barrels at different firing intervals.

Thus, known systems are complicated, limited to specific weapons, and/or do not succeed entirely in cooling barrels. A need exists for a cooling system that can be easily used with rapid-fire weapons and firearms to protect them from excess heat and damage.

BRIEF SUMMARY OF THE DISCLOSURE

The present disclosure is directed in general to a cooling system for barrels of weapons that are susceptible to excessive heat due to automatic or high rates of fire, such as from machine guns, artillery, cannons, and other automatic weapons. Copper is one of the best conductors of heat, but it cannot be placed directly on or around steel, the material from which barrels are usually constructed, because copper and steel will corrosively react. Thus, the present disclosure provides a sleeve made from brass, nickel, chromium, and the like, which is placed between copper cooling fins and barrels to prevent corrosion while the copper fins act to dissipate heat caused by high rates of fire. The barrel, receiver, chamber, magazine, and other parts of the weapons are also protected from heat by the heat-dissipating copper fins. The fins in turn can be protected from bending or damage by an outer cover such as a perforated steel shield.

In one embodiment, a corrosion prevention cooling system for a barrel of a weapon may include a plurality of cooling fins; a weapon barrel; and a cylinder made of corrosion-prevention material, the cylinder interposed between the weapon barrel and the cooling fins, wherein, when ammunition is fired at a high rate through the weapon barrel, the cylinder permits the cooling fins to dissipate heat from the weapon barrel while simultaneously protecting the weapon barrel from corrosively reacting with the cooling fins.

In this embodiment, the cooling fins may be made from copper, the weapon barrel may be made from steel, and the cylinder may be made from chromium. However, the cylinder can also be made from brass, nickel, or the like, including combinations thereof with chromium.

In another embodiment, a corrosion prevention cooling system for a barrel of a weapon may include a plurality of cooling fins; a weapon barrel; and a cylinder having at least a first layer of corrosion-prevention material, a second layer of a different corrosion-prevention material, and a plurality of corrosion-prevention inserts interspersed throughout the first layer and the second layer, the cylinder being interposed between the weapon barrel and the cooling fins, wherein, when ammunition is fired through the weapon barrel at a high rate, i.e., automatically, the first layer, the second layer, and the inserts of the cylinder permit the cooling fins to dissipate heat away from the weapon barrel while protecting the weapon barrel from corrosively reacting with the cooling fins.

In this embodiment, the cooling fins may be made from copper, the barrel may be made from steel, and the first layer may be brass, nickel, or chromium while the second layer may be brass, nickel, or chromium but preferably different from the first layer. For example, if the first layer is brass, the second layer may be chromium.

Also in this embodiment, one or more inserts may be interspersed through the first layer or the second layer, or both. The inserts may be brass, nickel, chromium, or amalgams thereof. The inserts may be orthogonal to the layers and the barrel, although they can be in randomized patterns.

In another embodiment according to the disclosure, a corrosion prevention cooling system for a weapon may include a plurality of cooling fins being made of a corrosion-prevention material; a weapon barrel also being made of the corrosion-prevention material, the weapon barrel having an inner surface and an outer surface; and a sleeve being made of material sufficient to withstand a projectile discharge through the weapon barrel, the sleeve having a first outer surface and a second inner surface, the sleeve being inserted within the weapon barrel; wherein the first outer surface of the sleeve abuts the inner surface of the weapon barrel, and the cooling fins depend from the outer surface of the weapon barrel; and wherein, when ammunition is fired through the sleeve within the weapon barrel at a high rate, the cooling fins to dissipate heat away from while simultaneously and the barrel does not corrosively react with the sleeve. The corrosion-prevention material of the cooling fins and/or the barrel may be aluminum or an aluminum alloy. Still further, the cooling fins and the barrel may be unitarily formed. Also, the sleeve may be made of steel, and the cooling fins may have a thickness of 0.030 to 0.060 inches (0.76-1.5 mm).

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter, including the best mode thereof directed to one of ordinary skill in the art, is set forth in the specification, which refers to the appended figures, wherein.

DETAILED DESCRIPTION OF THE DISCLOSURE

Figure 1:
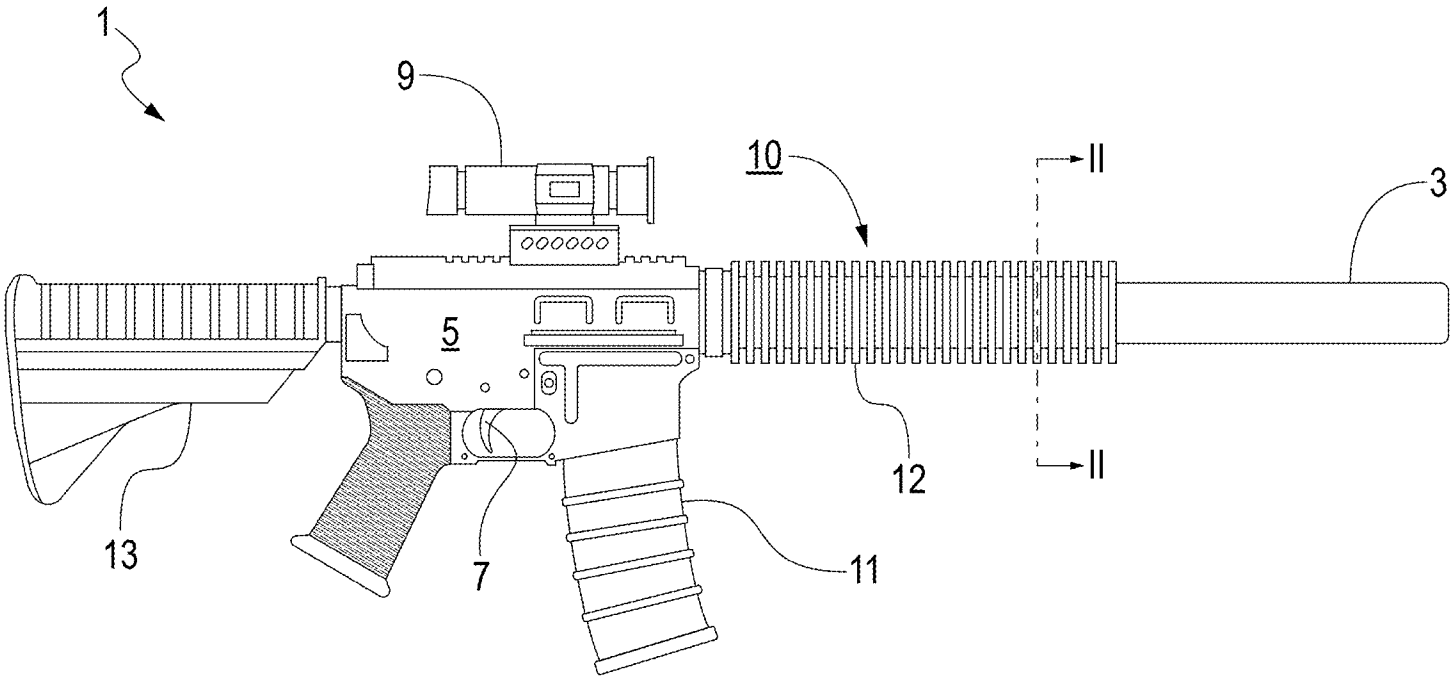
FIG. 1 is a side elevational view of a weapon having a cooling system according to an aspect of the disclosure.

As required, detailed embodiments are disclosed herein; however, the disclosed embodiments are merely examples and may be embodied in various forms. Therefore, specific structural and functional details disclosed herein are not to be interpreted as limiting, but merely as a basis for the claims and as a representative basis for teaching one skilled in the art to variously employ the exemplary embodiments of the present disclosure, as well as their equivalents.

Unless defined otherwise, all technical, engineering, and scientific terms used herein have the same meaning as is commonly understood by one of ordinary skill in the art to which this disclosure belongs. In the event that there is a plurality of definitions for a term, phrase, or acronym herein, those in this section prevail unless stated otherwise.

Wherever the phrase "for example," "such as," "including," and the like are used herein, the phrase "and without limitation" is understood to follow unless explicitly stated otherwise. Similarly, "an example," "exemplary," and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The term "ranges" includes all combinations of sub-ranges. For instance, a range from 100-200 includes ranges from, e.g., 110 to 150, 170 to 190, and 153 to 162. Similarly, "limits" means all sub-limit combinations, e.g., a limit of up to 7 also includes a limit of up to 5, up to 3, and up to 4.5.

The terms "comprising" and "including" and "having" and "involving" (and similarly "comprises," "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, et cetera. Thus, for example, "a device having components a, b, and c" means that the device includes at least components a, b, and c. Similarly, a phrase such as: "a method involving a, b, and c" means that the method includes at least steps a, b, and c.

Where a list of alternative component terms is used, e.g., "a structure such as 'a,' 'b,' 'c,' 'd' or the like," or "a or b," such lists and alternative terms provide meaning and context for the sake of illustration, unless indicated otherwise. Also, relative terms such as "first," "second," "third," "front," and "rear" are intended to identify or distinguish one component or feature from another similar component or feature, unless indicated otherwise herein.

Unless the context clearly requires otherwise, throughout the description and the claims, the words "comprise," "comprising," and the like are to be construed in an inclusive sense as opposed to an exclusive or exhaustive sense; in the sense of "including, but not limited to."

The phrase "corrosion-preventative," "corrosion prevention," "corrosion resistant," and like phrases and terms used as adjectives or amplifiers for metals and materials mean that the various components of the embodiments disclosed herein and their equivalents may include stainless steel, aluminum, titanium, copper alloys such as brass and bronze, chromium, and/or nickel and nickel-based alloys, as well as non-metals such as polypropylene and/or polytetrafluoroethylene.

The phrase "high rate" or "rate of fire" (ROF) as used herein means a cyclic rate for a firearm or other weapon such as a tank or cannon, i.e., the speed at which the weapon can cycle through firing, ejecting, loading, and cocking rounds measured in rounds per minute (RPM) when a trigger of the weapon is held or pulled in a firing position under ideal conditions, excluding operator involvement such as releasing, pausing, aiming, or reloading. For machine guns or automatic weapons, for instance, typical cyclic ROF can range from 600 to 1,200 RPM, with some weapons like a MAC-11 having ROF of 1,600 RPM and the M134 Minigun exceeding 6,000 RPM. By way of example, to determine the ROF of a machine gun fed with a 500-round ammunition belt, a timer begins once the trigger is pulled until the 500 rounds are expended. Assuming that the trigger is constantly held and it takes 30 seconds to expend the 500 rounds, the ROF is 1000 RPM: 500 rounds divided by 30 seconds multiplied by 60 seconds (in a minute). Thus, "high rate" as used herein means an ROF of between about 600 to about 6,000 RPM that can generate high heat in a short period of time.

The phrases "high heat," "high temperature," and equivalent terms as used herein with respect to barrels mean peak temperatures reached during sustained firing wherein an inner barrel chamber temperature can rise above 1470 °F (about 800 °C) due to propellant gases within the barrel reaching approximately 5430 °F (about 3000 °C) for a few milliseconds during each shot and external barrel temperatures potentially exceeding 1200 °F (649 °C) under continuous fire. Sustained high temperatures, such as 1470 °F+ internally and 1200 °F+ externally can lead to corrosion and structural failure if not mitigated.

The various embodiments of the disclosure and/or equivalents falling within the scope of present disclosure overcome or ameliorate at least one of the disadvantages of the prior art or provide a useful alternative.

Detailed reference will now be made to the drawings in which examples embodying the present subject matter are shown. The detailed description uses numerical and letter designations to refer to features of the drawings. The drawings and detailed description provide a full and written description of the present subject matter, and of the manner and process of making and using various exemplary embodiments, so as to enable one skilled in the pertinent art to make and use them, as well as the best mode of carrying out the exemplary embodiments. The drawings are not necessarily to scale, and some features may be exaggerated to show details of particular components. Thus, the examples set forth in the drawings and detailed descriptions are provided by way of explanation only and are not meant as limitations of the disclosure. The present subject matter thus includes any modifications and variations of the following examples as come within the scope of the appended claims and their equivalents.

Turning now to FIG. 1, a weapon is broadly designated by element number 1 with a cooling system 10. The weapon 1 may be a rifle, a mechanized or airborne cannon, an artillery piece, a machine gun, and the like, all having barrels 3 that are susceptible to overheating due to rapid fire. In this example, the weapon 1 is a rifle that includes the barrel 3, a receiver assembly 5, a trigger 7, a scope 9, a magazine 11, and a shoulder stock 13. Here, the cooling system 10 is shown with copper cooling projections or fins 12 arranged about the barrel 3. As will be explained in greater detail below, the copper cooling fins 12 dissipate heat from the barrel 3 to prevent overheating and damage to the barrel 3 that could render the weapon 1 unusable.

Figure 2:
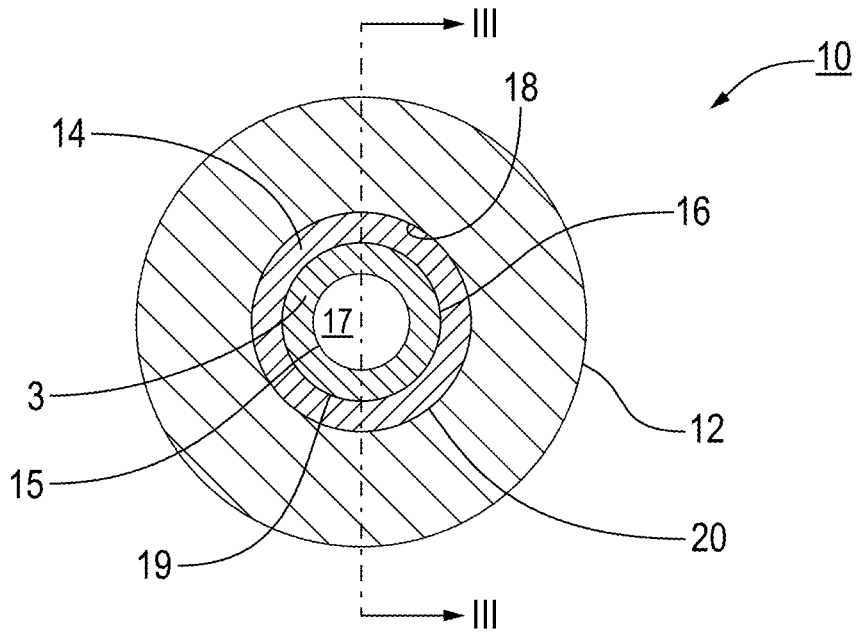
FIG. 2 is a cross section of the weapon and cooling system taken along lines II-II in FIG. 1.

With reference to FIG. 2, the cooling fins 12 are attached to or around a corrosion prevention ring, cylinder, sleeve, or insert 14 that, as shown, is interposed between the barrel 3 and the cooling fins 12. More particularly, the cylinder 14 can be made of chromium, brass, nickel, and the like to prevent the copper cooling fins 12 from contacting the barrel 3, which will typically be made of hardened steel or the like. Without the cylinder 14 over time the copper cooling fins 12 could corrosively react with the steel barrel 3.

FIG. 2 further shows that that the barrel 3 has an inner surface 15 that forms a bore 17 and an outer surface 19 that adjoins or abuts an inner surface 16 of the cylinder 14, which also has an outer surface 18 that in turn adjoins or abuts an inner surface 20 of the cooling fins 12. Thus, the corrosion-resistant material of the inner surface 16 contacts the barrel 3 to assist the copper cooling fins 12 in dissipating heat during firing of the weapon 1 while simultaneously preventing corrosion.

Figure 3:
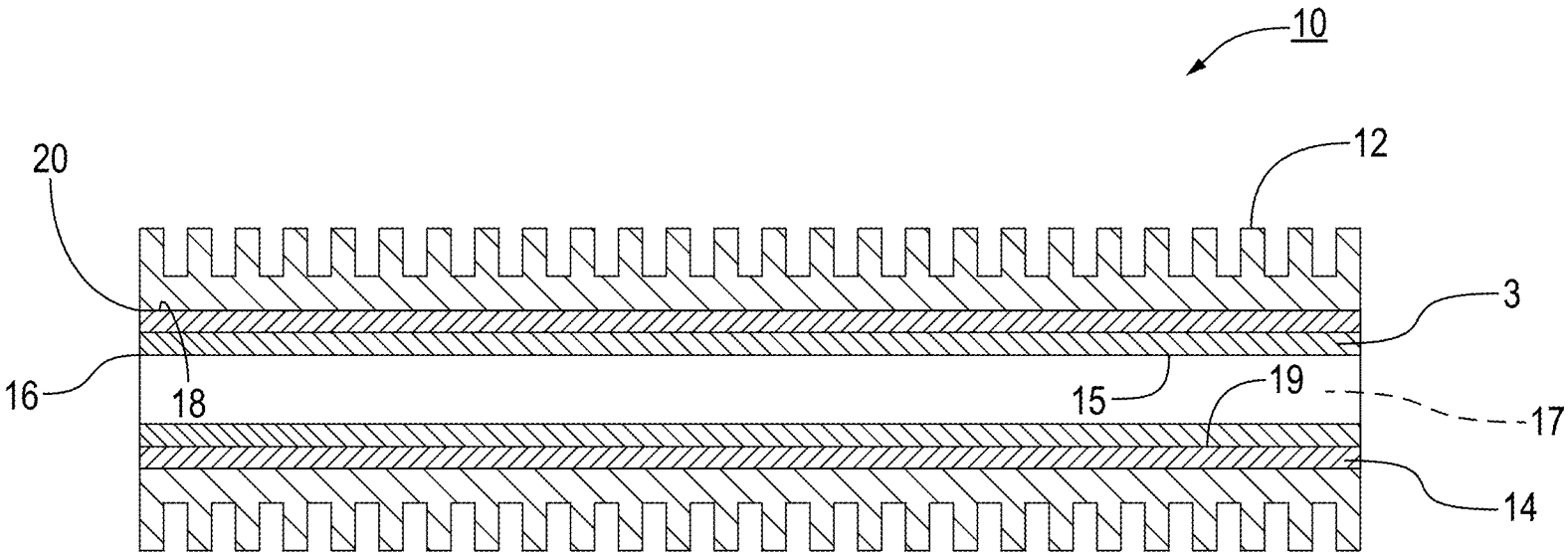
FIG. 3 is a cross section taken along lines III-III in FIG. 2.

FIG. 3 shows the cooling system 10 in cross section from a side elevational perspective. As noted above with respect to FIG. 2, the barrel 3 has the inner surface 15 that forms the bore 17 and the outer surface 19 that adjoins the inner surface 16 of the cylinder 14. The outer surface 18 of the cylinder 14 is shown abutting the inner surface 20 of the cooling fins 12.

Assorted sizes, shapes, and dimensions of the exemplary cooling fins 12 are possible and are not limited to the examples shown and described. Further, the cylinder 14 may be made of many combinations of chromium, brass, nickel, and the like, including having slugs or cylinders of brass, for instance, inserted at intervals along a length of the cylinder 14, which could be primarily made from chromium. Still further, the cylinder 14 could have multiple layers. For example, a layer adjoining the outer surface 19 of the barrel 3 could be chromium and a layer of the cylinder 14 adjoining the inner surface 20 of the cooling fins 12 could be brass.

Figure 4:
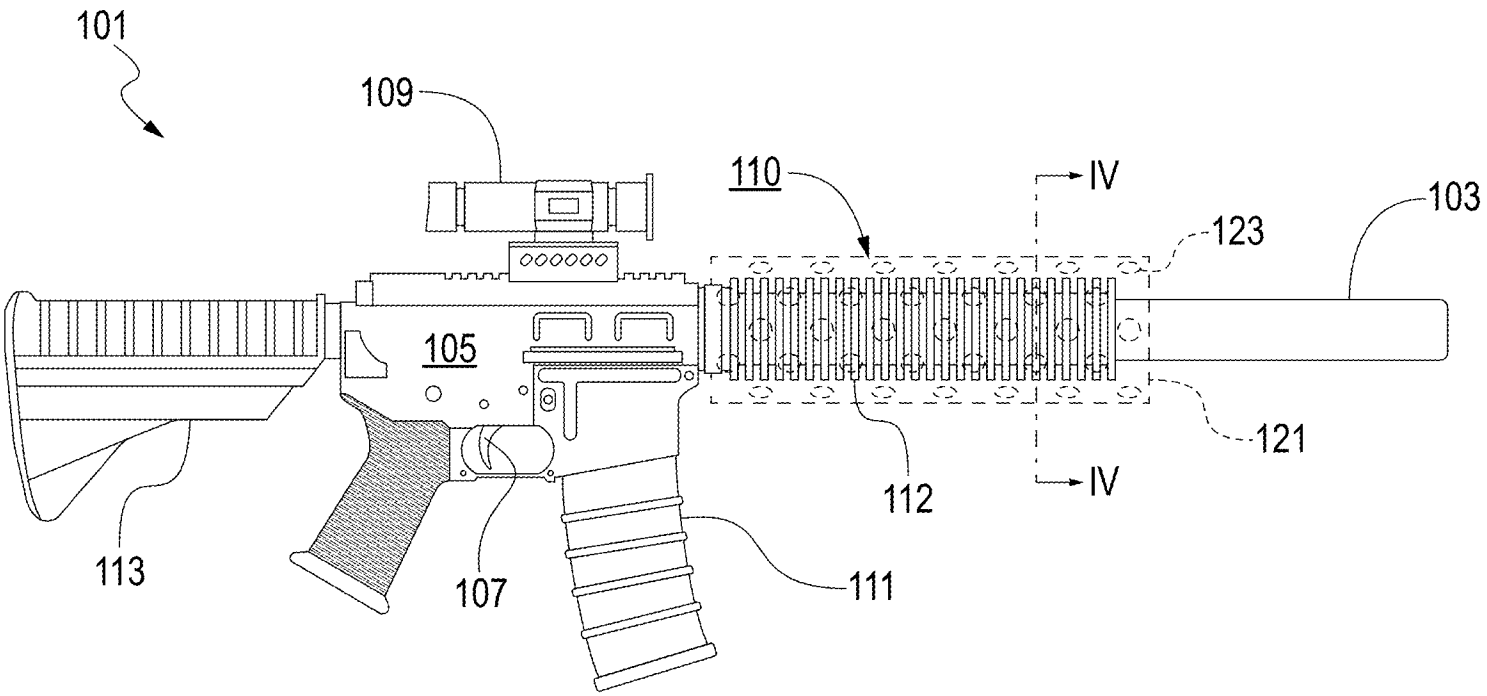
FIG. 4 is a side elevational view of another weapon having a cooling system according to another aspect of the disclosure.

Turning to FIG. 4, a weapon is broadly designated by element number 101 with a cooling system 110. The weapon 101 may be a rifle, a mechanized or airborne cannon, an artillery piece, a machine gun, and the like, all having barrels 103, typically made of steel, that are susceptible to overheating due to rapid firing of ammunition (not shown). In this example, the weapon 101 is a rifle that includes the barrel 103, a receiver assembly 105, a trigger 107, a scope 109, a magazine 111, and a shoulder stock 113. Also shown, the cooling system 110 includes copper cooling projections or fins 112 arranged about the barrel 103 to dissipate heat from the barrel 103 and prevent overheating and damage that could render the weapon 101 unusable. Still further, a perforated shield 121 having holes or vents 123 may be installed over or around all or portions of the cooling fins 112 to protect the fins 112 from damage, e.g., if the weapon 101 is dropped on the ground or impacted by external objects. The vents 123 permit ambient air to circulate about the cooling fins 112 and permit heat to escape.

Figure 5:
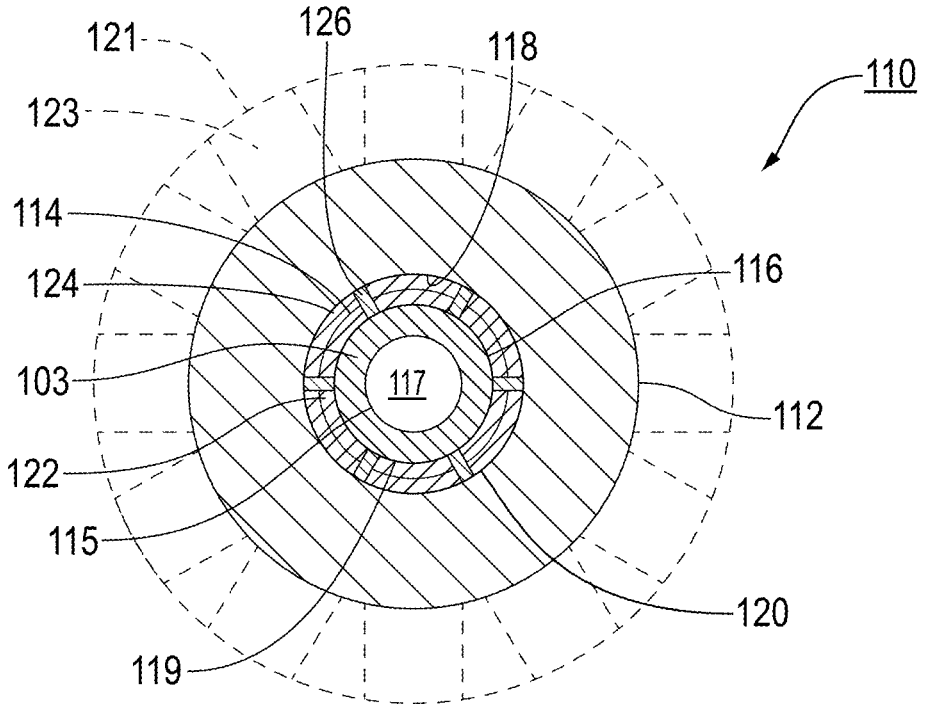
FIG. 5 is a cross section of the weapon and cooling system taken along lines IV-IV in FIG. 4.

As shown more particularly in FIG. 5, the cooling fins 112 are attached to or around a corrosion prevention ring, cylinder, sleeve, or insert 114 that, as shown, is interposed between the steel barrel 103 and the copper cooling fins 112. More particularly, the cylinder 114 may have at least two layers 122 and 124. One layer 122 may be made of chromium, brass, nickel, or the like and the other layer 124 may be made of a different one of the chromium, brass, nickel, or the like. For instance, layer 122 may be made of chromium and layer 124 may be made of brass such that the layers 122, 124 of the cylinder 114 act in concert to prevent the copper cooling fins 112 from contacting the steel barrel 103 to prevent a corrosive reaction. Still further, one or more rods or inserts 126, made of yet another material such as chromium, brass, nickel, or the like, or an amalgam of non-corrosive metals, may be inserted through one or both layers 122, 124 of the cylinder 114 to facilitate further cooling. By way of example, if the layer 122 is chromium and the layer 124 is brass, the inserts 126 may be nickel.

FIG. 5 further shows that that the barrel 103 has an inner surface 115 that forms a bore 117 and an outer surface 119 that adjoins or abuts an inner surface 116 of the layer 122 of the cylinder 114, which in turn has an outer surface 118 that adjoins or abuts an inner surface 120 of the cooling fins 112. Thus, the corrosion-resistant material of the inner surface 116 contacts the barrel 103 to assist the copper cooling fins 112 in dissipating heat during firing of the weapon 101 while simultaneously preventing corrosion.

Figure 6:
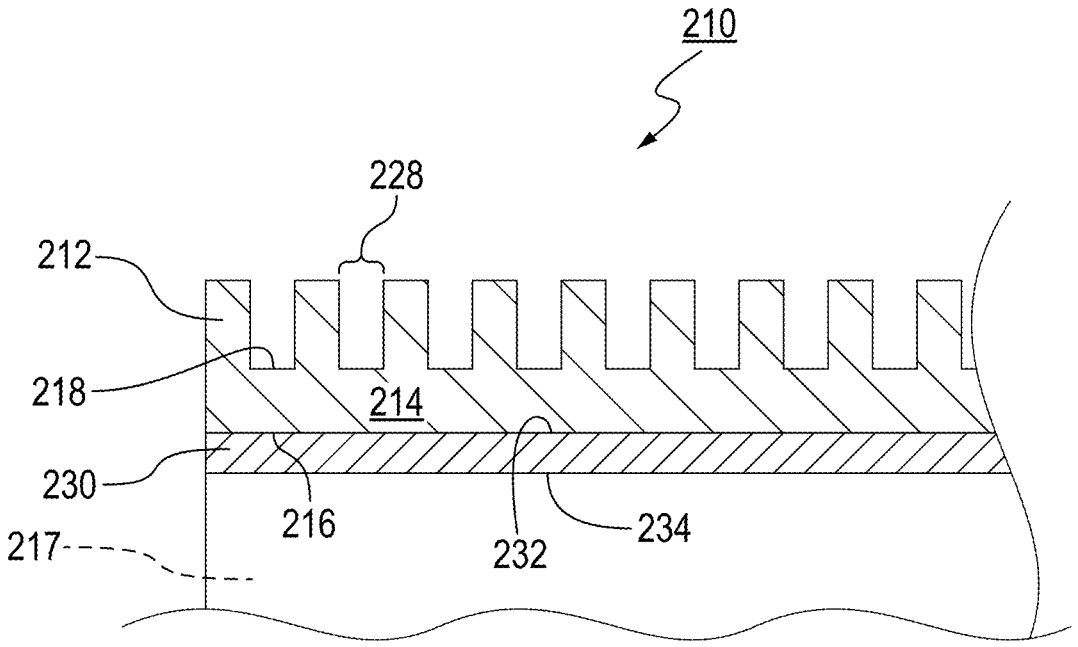
FIG. 6 is a partial cross sectional, elevational view of a portion of a weapon having a cooling system similar to FIGS. 1 and 3 according to another aspect of the disclosure

With reference to FIG. 6, another barrel cooling system is broadly indicated by the reference number 210. Here, the cooling system 210 is partly shown in cross section from a side elevational perspective. More particularly, the cooling system 210 includes a barrel 214 that may be made of aluminum or an aluminum alloy where other elements such as copper, magnesium, manganese, silicon, zinc, or nickel are mixed with aluminum as the predominant metal to enhance properties such as strength, corrosion resistance, workability, and electrical conductivity. As shown in this example, the barrel 214 includes an inner surface 216, an outer surface 218, and cooling fins 212. The cooling fins 212 may be homogeneously formed of aluminum (or an aluminum alloy) with the barrel 214. Here, therefore, the cooling fins 212 uniformly extend or project from the outer surface 218 of the barrel 214 with gaps or spaces 228 between each of the cooling fins 212. Each of the spaces 228 may be four (4) to twelve (12) fins per inch depending on fin length, width, height, and orientation or arrangement, and barrel diameter, rail systems, environmental factors constricting air flow, and other variables that will dictate overall surface area needed for adequate air passage to avoid thermal inefficiencies and provide optimal barrel cooling. By way of example, to optimize airflow and increase the surface area of the barrel 214 for more efficient heat dissipation, the fins 212 and the spaces 228 may be optimized for airflow such as spacing the fins 212 apart from each other from about 0.25 to 0.75 inches (6-19 mm) and forming the fins 212 with thicknesses around 0.030 to 0.060 inches (0.76-1.5 mm) such that the spaces 228 result in 2 to 4 fins per inch. These parameters may change depending on whether the fins 212 are oriented orthogonal to the barrel 214 as shown in the example of FIG. 6, or running parallel to the barrel 214, or arranged in some other pattern, such as an X pattern.

With continued reference to FIG. 6, an insert or sleeve 230 is shown incorporated in the barrel 214. The sleeve 230 has an outer surface 232 that abuts the inner surface 216 of the barrel 214 and an inner surface 234 forming a bore 217 therein. The sleeve 230 may be made of steel or other suitably durable metal to withstand heat and pressure associated with projectile discharges, particularly in an automatic weapon having a relatively high ROF. Alternatively, the sleeve 230 may be considered the barrel of the weapon and the barrel 214 and its fins 212 as described above may be considered a monolithic attachment to the barrel.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

By way of example and not of limitation, exemplary embodiments as disclosed herein may include but are not limited to:

EMBODIMENT 1: A corrosion prevention cooling system for a barrel of a weapon, comprising a plurality of cooling fins; a weapon barrel; and a cylinder made of corrosion-prevention material, the cylinder interposed between the weapon barrel and the cooling fins, wherein, when ammunition is fired at a high rate through the weapon barrel, the cylinder permits the cooling fins to dissipate heat from the weapon barrel while simultaneously protecting the weapon barrel from corrosively reacting with the cooling fins.

EMBODIMENT 2: The corrosion prevention cooling system as in Embodiment 1, wherein the cooling fins are made from copper.

EMBODIMENT 3: The corrosion prevention cooling system as in Embodiments 1 or 2, wherein the weapon barrel is made from steel.

EMBODIMENT 4: The corrosion prevention cooling system as in any of the foregoing embodiments, wherein the cylinder is made from chromium.

EMBODIMENT 5: The corrosion prevention cooling system as in any of the foregoing embodiments, wherein the cylinder is made from a material selected from the group consisting of brass, nickel, chromium, and combinations thereof.

EMBODIMENT 6: A corrosion prevention cooling system for a barrel of a weapon, comprising a plurality of cooling fins; a weapon barrel; and a cylinder having at least a first layer of corrosion-prevention material, a second layer of a different corrosion-prevention material, and a plurality of corrosion-prevention inserts interspersed throughout the first layer and the second layer, the cylinder being interposed between the weapon barrel and the cooling fins, wherein, when ammunition is fired through the weapon barrel at a high rate, the first layer, the second layer, and the inserts of the cylinder permit the cooling fins to dissipate heat away from the weapon barrel while protecting the weapon barrel from corrosively reacting with the cooling fins.

EMBODIMENT 7: The corrosion prevention cooling system for a barrel of a weapon as in Embodiment 6, wherein the cooling fins are made from copper.

EMBODIMENT 8: The corrosion prevention cooling system for a barrel of a weapon as in Embodiments 6 or 7, wherein the barrel is made from steel.

EMBODIMENT 9: The corrosion prevention cooling system for a barrel of a weapon as in Embodiments 6, 7, or 8, wherein the first layer is made of brass, nickel, or chromium, and the second layer is made of one of brass, nickel, or chromium not forming the first layer.

EMBODIMENT 10: The corrosion prevention cooling system for a barrel of a weapon as in Embodiments 6 through 9, further comprising a plurality of inserts interspersed through at least one of the first layer and the second layer, the inserts being made from a material selected from the group consisting of brass, nickel, chromium, and combinations thereof.

EMBODIMENT 11: A corrosion prevention cooling system for a barrel of a weapon, comprising a plurality of cooling fins; a weapon barrel; a cylinder having at least a first layer of corrosion-prevention material and a second layer of a different corrosion-prevention material, the cylinder interposed between the weapon barrel and the cooling fins; and a plurality of corrosion-prevention inserts interspersed throughout at least one of the first layer and the second layer, the plurality of corrosion-prevention inserts being orthogonal to (i) at least one of the first layer and the second layer, and (ii) the weapon barrel, wherein an inner surface of the first layer abuts an outer surface of the weapon barrel; and an outer surface of the second layer abuts an inner surface of the plurality of cooling fins; wherein, when ammunition is fired through the weapon barrel at a high rate, the first layer, the second layer, and the corrosion-prevention inserts permit the cooling fins to dissipate heat away from the weapon barrel while simultaneously protecting the weapon barrel from corrosively reacting with the cooling fins.

EMBODIMENT 12: The corrosion prevention cooling system for a barrel of a weapon as in Embodiment 11, wherein the cooling fins are made from copper.

EMBODIMENT 13: The corrosion prevention cooling system for a barrel of a weapon as in Embodiments 11 or 12, wherein the barrel is made from steel.

EMBODIMENT 14: The corrosion prevention cooling system for a barrel of a weapon as in Embodiments 11, 12, or 13, wherein the first layer is made from chromium, and the second layer is made from brass.

EMBODIMENT 15: The corrosion prevention cooling system for a barrel of a weapon as in Embodiments 11 through 13, wherein the first layer is made from brass, and the second layer is made from chromium.

EMBODIMENT 16: The corrosion prevention cooling system for a barrel of a weapon as in Embodiments 11 through 15, wherein the plurality of corrosion-prevention inserts interspersed throughout at least one of the first layer and the second layer are made from nickel.

EMBODIMENT 17: The corrosion prevention cooling system for a barrel of a weapon as in Embodiments 11 through 16, further comprising a protective shield positioned over at least a portion of the plurality of cooling fins, the protective shield having vents to permit (i) ambient air to circulate about the cooling fins, and (ii) heat to escape the system.

EMBODIMENT 18: A corrosion prevention cooling system for a barrel of a weapon, comprising a plurality of cooling fins; a weapon barrel; a cylinder having at least a first layer of corrosion-prevention material being made of brass, nickel, or chromium, and a second layer of a different corrosion-prevention material being made of brass, nickel, or chromium not forming the first layer, the cylinder being interposed between the weapon barrel and the cooling fins; and a plurality of corrosion-prevention inserts interspersed throughout at least one of the first layer and the second layer, the plurality of corrosion-prevention inserts being orthogonal to (i) at least one of the first layer and the second layer, and (ii) the weapon barrel, wherein an inner surface of the first layer abuts an outer surface of the weapon barrel; and an outer surface of the second layer abuts an inner surface of the plurality of cooling fins; wherein, when ammunition is fired through the weapon barrel at a high rate, the first layer, the second layer, and the corrosion-prevention inserts permit the cooling fins to dissipate heat away from the weapon barrel while simultaneously protecting the weapon barrel from corrosively reacting with the cooling fins.

EMBODIMENT 19: The corrosion prevention cooling system for a barrel of a weapon as in Embodiment 18, wherein the cooling fins are made from copper.

EMBODIMENT 20: The corrosion prevention cooling system for a barrel of a weapon as in Embodiments 18 and 19, wherein the barrel is made from steel.

EMBODIMENT 21: The corrosion prevention cooling system for a barrel of a weapon as in Embodiments 18, 19, and 20, wherein the first layer is made from chromium, and the second layer is made from brass.

EMBODIMENT 22: The corrosion prevention cooling system for a barrel of a weapon as in Embodiments 18 through 20, wherein the first layer is made from brass, and the second layer is made from chromium.

EMBODIMENT 23: The corrosion prevention cooling system for a barrel of a weapon as in Embodiments 18 through 22, wherein the plurality of corrosion-prevention inserts interspersed throughout at least one of the first layer and the second layer are made from nickel.

EMBODIMENT 24: The corrosion prevention cooling system for a barrel of a weapon as in Embodiments 18 through 23, further comprising a protective shield positioned over at least a portion of the plurality of cooling fins, the protective shield having vents to permit (i) ambient air to circulate about the cooling fins, and (ii) heat to escape the system.

EMBODIMENT 25: A corrosion prevention cooling system for a barrel of a weapon, comprising a plurality of cooling fins; a weapon barrel; a cylinder having at least a first layer of corrosion-prevention material being made of brass, chromium, aluminum, titanium, or nickel, and a second layer of a different corrosion-prevention material being made of brass, chromium, aluminum, titanium, or nickel not forming the first layer, the cylinder being interposed between the weapon barrel and the cooling fins; a plurality of corrosion-prevention inserts interspersed throughout at least one of the first layer and the second layer, the plurality of corrosion-prevention inserts being orthogonal to (i) at least one of the first layer and the second layer, and (ii) the weapon barrel, wherein an inner surface of the first layer abuts an outer surface of the weapon barrel; and an outer surface of the second layer abuts an inner surface of the plurality of cooling fins; and a perforated shield positioned over at least a portion of the plurality of cooling fins; wherein, when ammunition is fired through the weapon barrel at a high rate, the first layer, the second layer, and the corrosion-prevention inserts permit the cooling fins to dissipate heat away from the weapon barrel while simultaneously protecting the weapon barrel from corrosively reacting with the cooling fins.

EMBODIMENT 26: The corrosion prevention cooling system for a barrel of a weapon as in Embodiment 25, wherein the cooling fins are made from copper, polypropylene, or polytetrafluoroethylene.

EMBODIMENT 27: The corrosion prevention cooling system for a barrel of a weapon as in Embodiments 25 or 26, wherein the first layer cylinder is made from chromium, and the second layer is made from brass.

EMBODIMENT 28: The corrosion prevention cooling system for a barrel of a weapon as in Embodiments 25, 26, or 27, wherein the first layer is made from brass, and the second layer is made from chromium.

EMBODIMENT 29: The corrosion prevention cooling system for a barrel of a weapon as in Embodiments 25 through 28, wherein the plurality of corrosion-prevention inserts interspersed throughout at least one of the first layer and the second layer are made from nickel nickel, polypropylene, polytetrafluoroethylene and combinations thereof.

EMBODIMENT 30: A corrosion prevention cooling system for a weapon, comprising plurality of cooling fins being made of a corrosion-prevention material: a weapon barrel also being made of the corrosion-prevention material, the weapon barrel having an inner surface and an outer surface; and a sleeve being made of material sufficient to withstand a projectile discharge through the weapon barrel, the sleeve having a first outer surface and a second inner surface, the sleeve being inserted within the weapon barrel: wherein the first outer surface of the sleeve abuts the inner surface of the weapon barrel, and the cooling fins depend from the outer surface of the weapon barrel; and wherein, when ammunition is fired through the sleeve within the weapon barrel at a high rate, the cooling fins to dissipate heat away from while simultaneously and the barrel does not corrosively react with the sleeve.

EMBODIMENT 31: The corrosion prevention cooling system for a weapon as in Embodiment 30, wherein the corrosion-prevention material of the cooling fins is made of aluminum or an aluminum alloy.

EMBODIMENT 32: The corrosion prevention cooling system for a barrel of a weapon as in Embodiments 30 or 31, wherein the corrosion-prevention material of the barrel is made of aluminum or an aluminum alloy.

EMBODIMENT 33: The corrosion prevention cooling system for a weapon as in Embodiments 30, 31, or 32, wherein the cooling fins and the barrel are unitarily formed.

EMBODIMENT 34: The corrosion prevention cooling system for a weapon as in Embodiments 30 through 33, wherein the sleeve is made of steel.

EMBODIMENT 35: The corrosion prevention cooling system for a weapon as in Embodiments 30 through 34, wherein the cooling fins each have a thickness of 0.030 to 0.060 inches (0.76-1.5 mm).

The invention claimed is:

1. A corrosion prevention cooling system for a weapon, comprising:

a weapon barrel having a barrel outer surface;

a plurality of cooling fins made of copper, each of the plurality of cooling fins having a fin inner surface; and a cylinder made of a corrosion-prevention chromium material interposed between the weapon barrel and the plurality of cooling fins, the cylinder having a cylinder inner surface and a cylinder outer surface, the cylinder inner surface abutting the barrel outer surface, and the cylinder outer surface abutting the fin inner surface of at least one of the plurality of cooling fins, the cylinder includes a first layer made of the chromium material and a second layer made of brass;

wherein the cylinder separates the plurality of cooling fins from the weapon barrel to prevent the plurality of cooling fins made of copper from corrosively reacting with the weapon barrel.

2. The corrosion prevention cooling system as in claim 1, wherein the cylinder further includes nickel.

* * * * *